US008876543B2

(12) United States Patent
Oka et al.

(10) Patent No.: US 8,876,543 B2
(45) Date of Patent: Nov. 4, 2014

(54) CONNECTOR

(71) Applicant: Japan Aviation Electronics Industry, Limited, Tokyo (JP)

(72) Inventors: Toshihiro Oka, Tokyo (JP); Nobuhiro Ogawa, Tokyo (JP); Shigeyasu Kitamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 66 days.

(21) Appl. No.: 13/871,056

(22) Filed: Apr. 26, 2013

(65) Prior Publication Data

US 2013/0288512 A1 Oct. 31, 2013

(30) Foreign Application Priority Data

Apr. 27, 2012 (JP) ..... 2012-103075

(51) Int. Cl.

| | |
|---|---|
| ***H01R 13/62*** | (2006.01) |
| ***H01R 13/627*** | (2006.01) |
| ***H01R 13/422*** | (2006.01) |
| *H01R 9/05* | (2006.01) |

(52) U.S. Cl.

CPC ..... *H01R 13/6272* (2013.01); *H01R 13/4223* (2013.01); *H01R 9/0518* (2013.01)

USPC ..... 439/353

(58) Field of Classification Search

USPC ..... 439/352, 353, 357, 358, 752, 595

See application file for complete search history.

(56) References Cited

U.S. PATENT DOCUMENTS

| | | | | |
|---|---|---|---|---|
| 3,713,076 | A * | 1/1973 | Gabrielian et al. | 439/352 |
| 4,801,275 | A * | 1/1989 | Ikeda et al. | 439/350 |
| 4,925,398 | A * | 5/1990 | Samejima et al. | 439/357 |
| 4,941,839 | A * | 7/1990 | Nagasaka et al. | 439/352 |
| 4,946,395 | A * | 8/1990 | Cope et al. | 439/352 |
| 5,178,552 | A * | 1/1993 | Jinno et al. | 439/140 |
| 5,330,366 | A * | 7/1994 | Tsuji et al. | 439/352 |
| 5,380,217 | A * | 1/1995 | Yagi et al. | 439/358 |
| 5,554,044 | A * | 9/1996 | Nishide | 439/352 |
| 5,664,961 | A * | 9/1997 | Tsuji et al. | 439/358 |
| 5,873,747 | A * | 2/1999 | Tsuji | 439/357 |
| 6,454,463 | B1 * | 9/2002 | Halbach et al. | 385/60 |
| 6,652,328 | B2 * | 11/2003 | Suzuki | 439/752 |

(Continued)

FOREIGN PATENT DOCUMENTS

| | | |
|---|---|---|
| JP | 62-18980 | 2/1987 |
| JP | 2005-135751 | 5/2005 |

(Continued)

*Primary Examiner* — Alexander Gilman

(74) *Attorney, Agent, or Firm* — Collard & Roe, P.C.

(57) ABSTRACT

A connector is mateable with a mating connector having a mating terminal. The connector comprises a housing and a terminal held by the housing. The housing has an accommodating portion and a lock portion which are formed integrally. The terminal is accommodated in the accommodating portion so as to be connectable to the mating terminal. When the connector is in a mated state where the connector is mated with the mating connector, the lock portion locks the mated state. In detail, the lock portion has a flexible portion and a lock protrusion. The flexible portion is located over the accommodating portion. The lock protrusion is provided on the flexible portion. No wall is provided between the flexible portion and the accommodating portion so that the flexible portion is resiliently deformable toward the accommodating portion. The lock protrusion moves downward when the flexible portion is resiliently deformed downward.

9 Claims, 9 Drawing Sheets

(56) References Cited

U.S. PATENT DOCUMENTS

| | | | | |
|---|---|---|---|---|
| 6,752,648 | B2 * | 6/2004 | Kashiyama et al. | 439/489 |
| 6,902,420 | B2 * | 6/2005 | Muro et al. | 439/358 |
| 6,902,432 | B2 * | 6/2005 | Morikawa et al. | 439/607.41 |
| 6,997,749 | B1 * | 2/2006 | Harubayashi | 439/607.45 |
| 7,204,725 | B2 * | 4/2007 | Yamashita | 439/752 |
| 7,214,085 | B2 * | 5/2007 | Ohtaka et al. | 439/352 |
| 7,632,130 | B2 * | 12/2009 | Sami | 439/352 |
| 2005/0106924 | A1 * | 5/2005 | Roese | 439/352 |
| 2013/0288512 | A1 * | 10/2013 | Oka et al. | 439/353 |

FOREIGN PATENT DOCUMENTS

| | | |
|---|---|---|
| JP | 2006-054057 | 2/2006 |
| JP | 2006-079922 | 3/2006 |
| JP | 2009-181968 | 8/2009 |
| JP | 2009-224111 | 10/2009 |

* cited by examiner

CONNECTOR

CROSS REFERENCE TO RELATED APPLICATIONS

An applicant claims priority under 35 U.S.C. §119 of Japanese Patent Application No. JP2012-103075 filed Apr. 27, 2012.

BACKGROUND OF THE INVENTION

This invention relates to a connector mateable with a mating connector and having a structure for locking a mated state of the connector with the mating connector.

For example, this type of connector is disclosed in JP-A 2006-54057 (Patent Document 1), JP-A 2005-135751 (Patent Document 2) and JP-U S62(1987)-18980 (Patent Document 3), contents of which are incorporated herein by reference.

As can be seen from FIG. 15, the receptacle connector (connector) disclosed in Patent Document 1 is configured to be mateable with a plug connector (mating connector). The receptacle connector comprises a lock portion. The lock portion is cantilevered so as to have a free end and a fixed end. The free end is provided with a pressed portion (operation portion). The lock portion has an engaged portion (lock protrusion) formed between the free end and the fixed end thereof. The plug connector is formed with a locked portion. In a mating process of the receptacle connector with the plug connector, the engaged portion is bent to be inserted into the plug connector. When the receptacle connector is mated with the plug connector, the engaged portion returns to its initial position to be engaged with the locked portion so that a mated state is locked.

As can be seen from FIG. 16, the female connector (connector) disclosed in Patent Document 2 is configured to be mateable with a male connector (mating connector). The female connector comprises a housing and a locking arm (lock portion) formed integrally with the housing. The housing is formed with an accommodating portion for accommodating a terminal. The locking arm is located over the accommodating portion with a wall therebetween. The locking arm is a fixed-fixed beam having opposite fixed ends. The locking arm is formed with a lock protrusion at a middle part between the two fixed ends. The locking arm is formed with a release-operation portion (operation portion) in the vicinity of one of the fixed ends. When the female connector is mated with the male connector, the lock protrusion locks a mated state.

As can be seen from FIG. 17, the connector disclosed in Patent Document 3 is configured to be mateable with a mating connector. The connector comprises a housing and a cover formed separately from each other. The housing is formed with an accommodating space (accommodating portion). The cover is provided with a lock member (lock portion). The lock member is a fixed-fixed beam located over the accommodating space. The lock member is formed with an engaged tab (lock protrusion) at a middle part between two fixed ends thereof. The lock member is formed with an engagement releaser (operation portion) in the vicinity of one of the fixed ends. When the connector is mated with the mating connector, the engaged tab locks a mated state.

When the connector of each of Patent Documents 1 to 3 is mated with or removed from the mating connector, the lock protrusion of the connector is required to move by a predetermined distance.

The lock portion of the connector of Patent Document 1 is supported in a cantilever structure. Accordingly, it is necessary to move the operation portion by an amount larger than the predetermined distance in order to move the lock protrusion by the predetermined distance. It is therefore necessary to form a space, which allows the large movement of the operation portion, in the connector. As a result, the connector may have a large size.

The lock portion of the connector of Patent Document 2 is supported in a both-ends support structure. Accordingly, a relatively small movement of the operation portion moves the lock protrusion by the predetermined distance. It is therefore possible to reduce the size of the connector. However, it is necessary to provide the wall between the lock portion and the accommodating portion in order to integrally form the housing and the fixed-fixed beam of the lock portion by a metal mold. Accordingly, the size of the connector becomes large by the thickness of the wall.

The lock portion of the connector of Patent Document 3 is supported in a both-ends support structure. Moreover, any wall is not provided between the lock portion and the accommodating portion. Accordingly, it is possible to further reduce the size of the connector.

However, according to Patent Document 3, it is necessary to separately form the cover (i.e. the lock portion) and the housing (i.e. the accommodating portion) from each other in order to configure the connector without using a complicated metal mold. In other words, the connector of Patent Document 3 is formed by combining a plurality of components which are made separately from one another. Accordingly, the cost of manufacture may increase.

SUMMARY OF THE INVENTION

It is therefore an object of the present invention to provide a connector having a new lock structure which is configured to lock a mated state of the connector with a mating connector. The lock structure according to the present invention is able to be formed from fewer components and allows the connector to have a reduced size.

One aspect of the present invention provides a connector mateable with a mating connector positioned forward along a front-rear direction. The mating connector comprises a mating terminal. The connector comprises a terminal and a housing. The terminal is connectable to the mating terminal. The housing has an upper wall, an accommodating portion and a lock portion which are formed integrally. The upper wall is located at an upper part of the housing in an up-down direction perpendicular to the front-rear direction. The upper wall is formed with a ditch extending to a rear end of the upper wall in the front-rear direction. The ditch has a through hole piercing the upper wall in the up-down direction. The accommodating portion is located under the upper wall while communicating with the ditch. The accommodating portion accommodates the terminal inserted thereinto along the front-rear direction from behind the connector. The lock portion has a flexible portion. The flexible portion is provided with a lock protrusion protruding upward. The lock portion extends in the front-rear direction so that the flexible portion is located inside of the through hole in a width direction perpendicular to both the front-rear direction and the up-down direction. At least one of opposite ends of the lock portion in the front-rear direction is supported by the housing so that the flexible portion is resiliently deformable into the through hole. The lock protrusion is movable in the up-down direction by a resilient deformation of the flexible portion. The lock protrusion locks the mating connector when the connector is mated with the mating connector.

An appreciation of the objectives of the present invention and a more complete understanding of its structure may be had by studying the following description of the preferred embodiment and by referring to the accompanying drawings.

Figure 1:
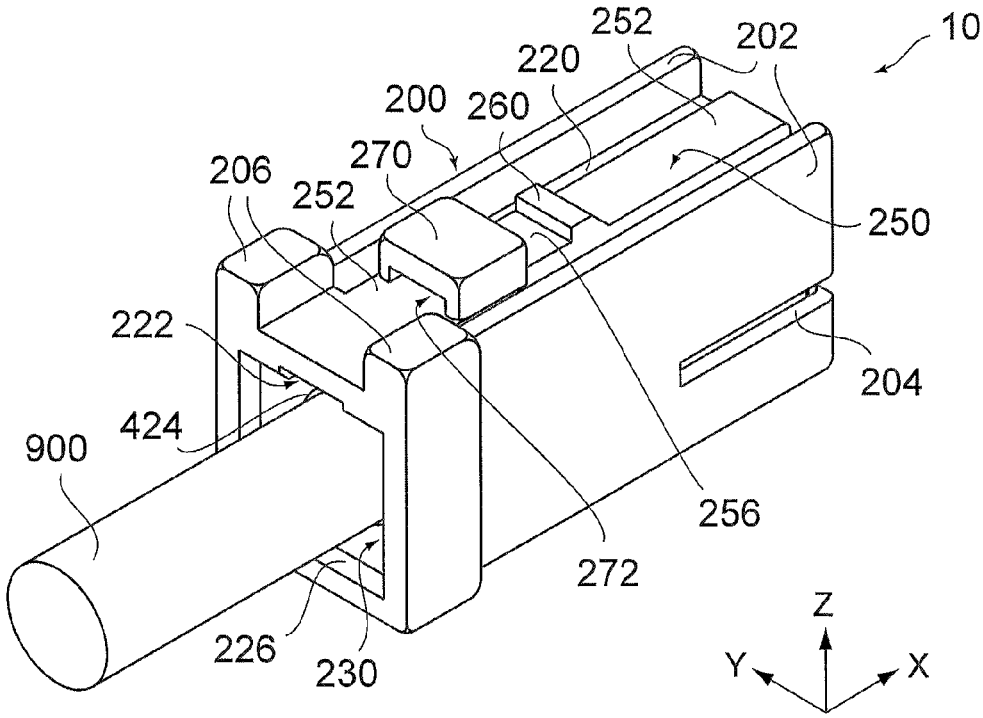
FIG. 1 is a perspective view showing a connector according to an embodiment of the present invention, wherein the connector is connected to a cable.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
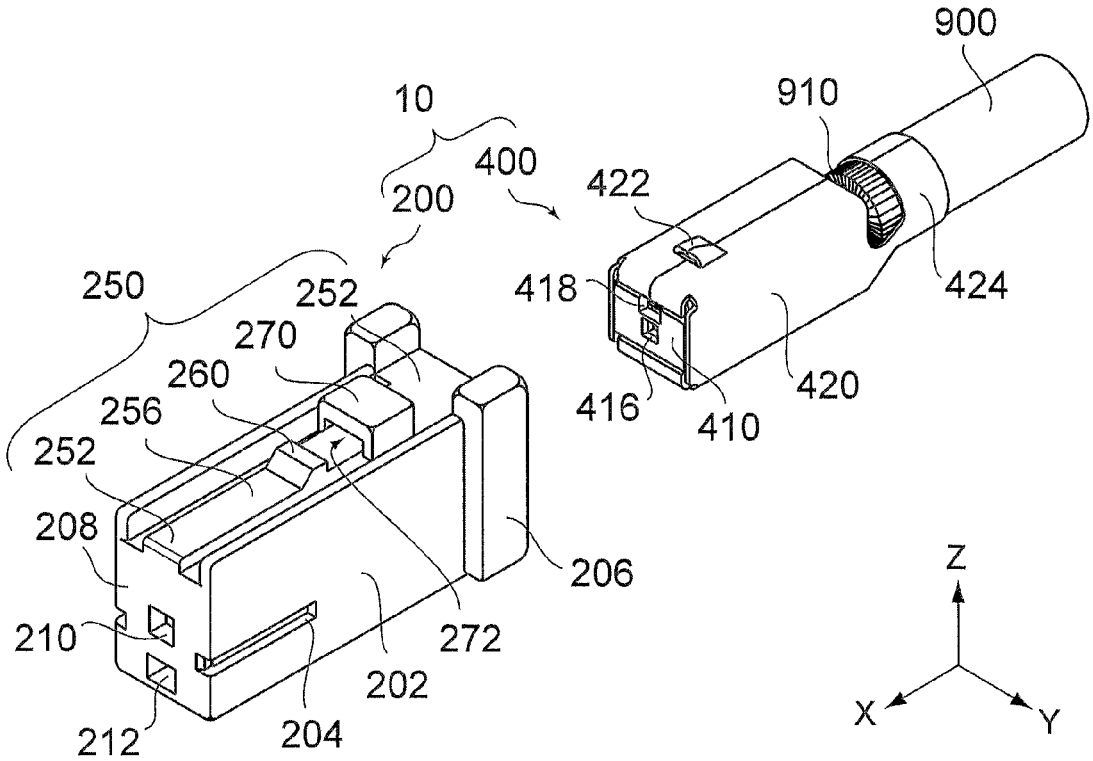
FIG. 2 is a partially exploded view showing the connector of FIG. 1, wherein a terminal of the connector is connected to the cable.
Figure 12:
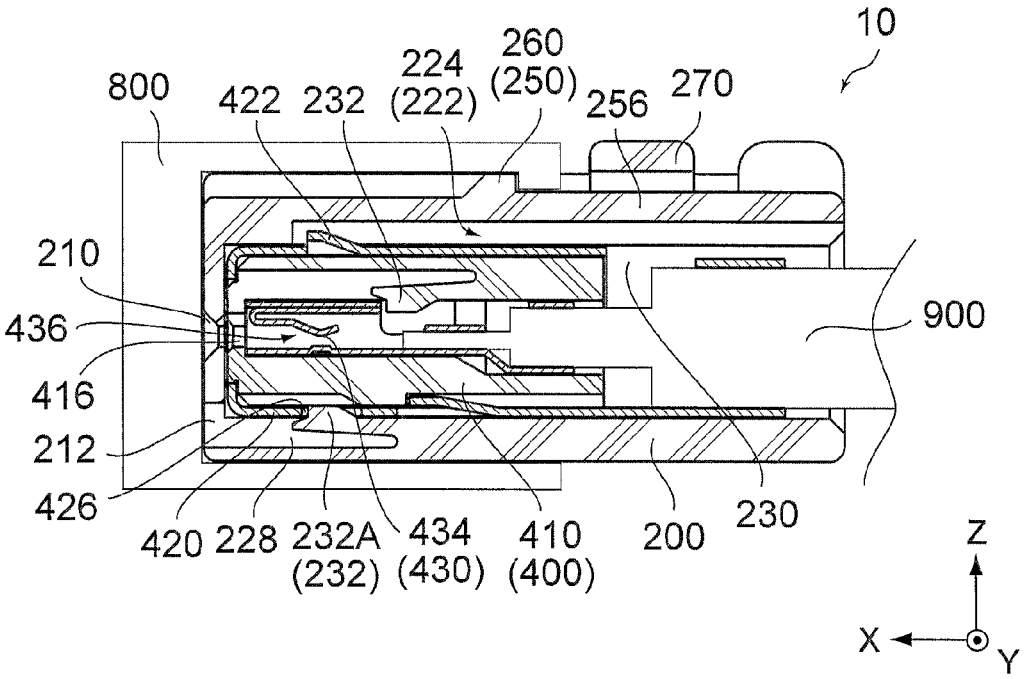
FIG. 12 is a cross-sectional view showing the connector of FIG. 11, taken along line XII-XII, wherein outlines of the cable and a mating connector are schematically illustrated.

As can be seen from FIGS. 1, 2 and 12, a connector 10 according to an embodiment of the present invention is mateable with a mating connector 800 (see FIG. 12) positioned forward along a front-rear direction (X-direction). The mating connector 800 comprises a mating terminal (not shown). For example, the connector 10 according to the present embodiment is configured to be attached to an end of a harness and connected to the mating connector 800 mounted on a circuit board. However, the present invention is applicable to another type of connector.

As shown in FIGS. 1 and 2, the connector 10 comprises a housing 200 made of an insulating material and a terminal 400. The housing 200 holds the terminal 400. The terminal 400 is connected to the mating terminal (not shown) under a mated state where the connector 10 is mated with the mating connector 800. In other words, the terminal 400 is connectable to the mating terminal. According to the present embodiment, the terminal 400 is attached with a cable 900.

Figure 10:
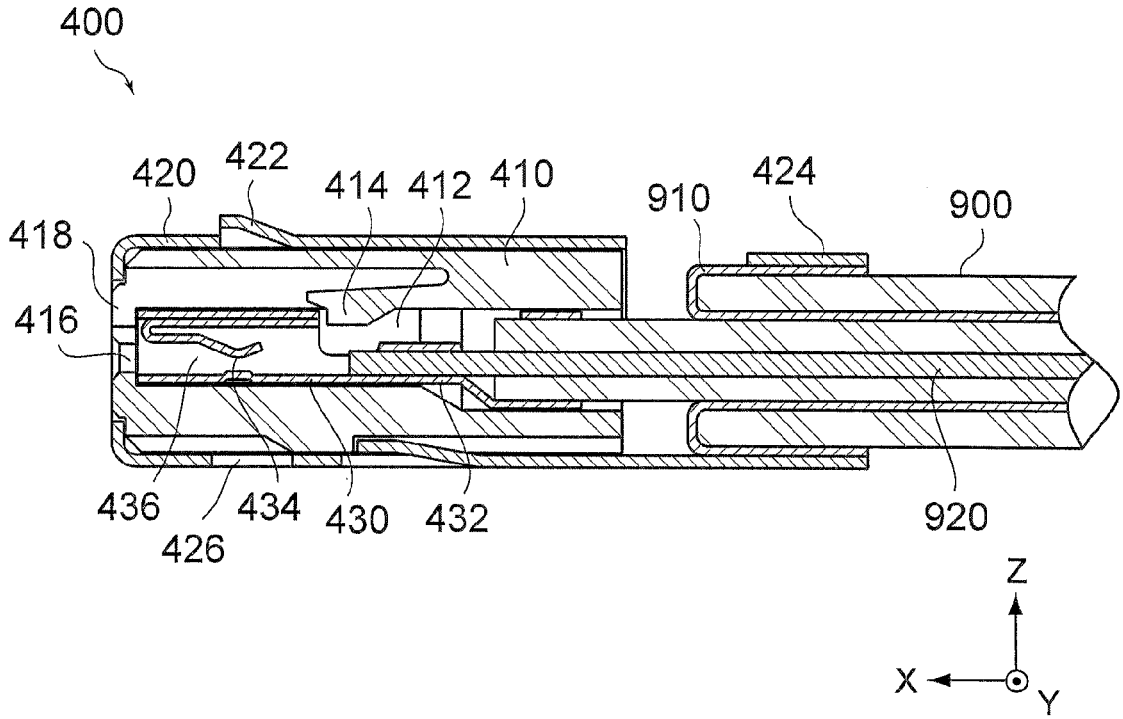
FIG. 10 is a cross-sectional view showing the terminal of FIG. 9, taken along line X-X.

As shown in FIGS. 2 and 10, the cable 900 comprises an outer conductor (ground line) 910 and an inner conductor (power line) 920 separated from each other by an insulating material.

Figure 9:
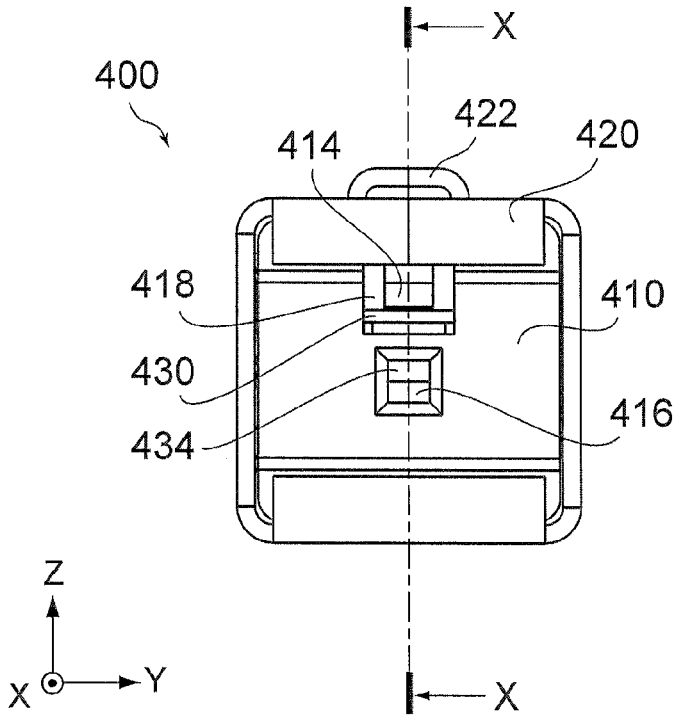
FIG. 9 is a front view showing the terminal of the connector of FIG. 2.

As shown in FIGS. 2, 9 and 10, the terminal 400 according to the present embodiment is fixed to an end of the cable 900. The terminal 400 comprises a terminal housing 410 made of an insulating material, a shell 420 made of a conductive material and a contact 430 made of a conductive material. However, the present invention is applicable to a terminal other than the terminal 400. For example, the terminal may be formed from a single metal plate.

As can be seen from FIG. 10, the contact 430 according to the present embodiment is formed from a single metal plate by punching and bending in a press. The contact 430 has a connection portion 432, a contact portion 434 and a contact-accommodating portion 436. The connection portion 432 is connected to the inner conductor 920 of the cable 900 so that the contact 430 (i.e. terminal 400) and the inner conductor 920 are electrically connected to each other. The contact portion 434 is formed in the vicinity of the positive X-side end of the contact 430. The contact portion 434 is located within the contact-accommodating portion 436. The contact portion 434 is resiliently supported so as to be movable in an up-down direction (Z-direction) perpendicular to the front-rear direction (X-direction).

As can be seen from FIGS. 2 and 10, the terminal housing 410 has a rectangular column-like shape extending in the X-direction. The terminal housing 410 holds the contact 430. In detail, the terminal housing 410 is formed with a terminal-accommodating portion 412 therewithin. The terminal-accommodating portion 412 extends along the negative X-direction to open rearward. In other words, the terminal 400 has an opening formed at the negative X-side end thereof. The contact 430 connected to the cable 900 is inserted from the opening of the terminal 400 to be accommodated in the terminal-accommodating portion 412.

As shown in FIG. 10, the terminal-accommodating portion 412 is formed with a terminal lance 414. The terminal lance 414 is configured to lock the contact 430 accommodated in the terminal-accommodating portion 412. In detail, when the contact 430 is pulled rearward (i.e. in the negative X-direction), the contact 430 is brought into abutment with the terminal lance 414 so that the contact 430 is prevented from being removed unintentionally.

As shown in FIGS. 2, 9 and 10, the terminal housing 410 is formed with a terminal-connection hole 416 and a terminal-release hole 418 at a front end (i.e. positive X-side end) thereof. Each of the terminal-connection hole 416 and the terminal-release hole 418 pierces the front end of the terminal housing 410 in the X-direction to communicate with the terminal-accommodating portion 412. When the terminal 400 is seen rearward (i.e. along the negative X-direction), an end of the contact portion 434 and an end of the terminal lance 414 are visible through the terminal-connection hole 416 and the terminal-release hole 418, respectively (see FIG. 9). Accordingly, it is possible to release the lock of the terminal lance 414 with the contact 430, for example, by pushing up the end of the terminal lance 414 with a tool inserted from the terminal-release hole 418.

The shell 420 covers most of a side part of the terminal housing 410 and a part of the front end of the terminal housing 410. The shell 420 has a rear end (i.e. negative X-side end) extending rearward so that the shell 420 is formed with a holding portion 424. According to the present embodiment, the shell 420 is attached to the terminal housing 410 when the terminal 400 is assembled. Then, the contact 430, which is attached to the cable 900, is accommodated in the terminal housing 410. Then, the holding portion 424 crimps the outer conductor 910 of the cable 900 so that the shell 420 is attached to the cable 900. More specifically, the holding portion 424 is wound on the outer conductor 910 of the cable 900 so that the shell 420 (i.e. the terminal 400) and the outer conductor 910 are electrically connected to each other.

The terminal 400 is provided with a protrusion 422 at an upper part (i.e. positive Z-side part) thereof. The protrusion 422 according to the present embodiment is a part of the shell 420. The shell 420 is formed from a metal sheet. The opposite ends of the metal sheet in a width direction (Y-direction) perpendicular to both the front-rear direction (X-direction) and the up-down direction (Z-direction) are joined to each other on the terminal housing 410. The aforementioned joined part of the shell 420 is partially bent upward so that the protrusion 422 is formed. However, the protrusion 422 may not be a part of the shell 420. For example, the protrusion 422 may be a part of the terminal housing 410 which protruding over the shell 420.

As shown in FIG. 10, the terminal 400 is provided with an engaged portion 426 at a lower part (i.e. negative Z-side part) thereof. The engaged portion 426 according to the present embodiment is a part of the shell 420. In detail, a lower surface of the shell 420 is partially cut so that the engaged portion 426 is formed.

As shown in FIGS. 1 and 2, the housing 200 according to the present embodiment has a rectangular column-like shape extending in the X-direction. In detail, the housing 200 has two side walls 202, a front wall 208, an upper wall 220 and a bottom plate 226. The side walls 202 are formed at opposite ends of the housing 200 in the Y-direction, respectively. The front wall 208 is formed at a front end of the housing 200 in the X-direction. The upper wall 220 is formed at an upper part of the housing 200 in the Z-direction. The bottom plate 226 is formed at a lower end of the housing 200 in the Z-direction. Each of the side walls 202, the front wall 208 and the bottom plate 226 has a plate-like shape. The side walls 202 extend upward beyond an upper end (i.e. positive Z-side end) of the front wall 208 in the Z-direction.

Figure 5:
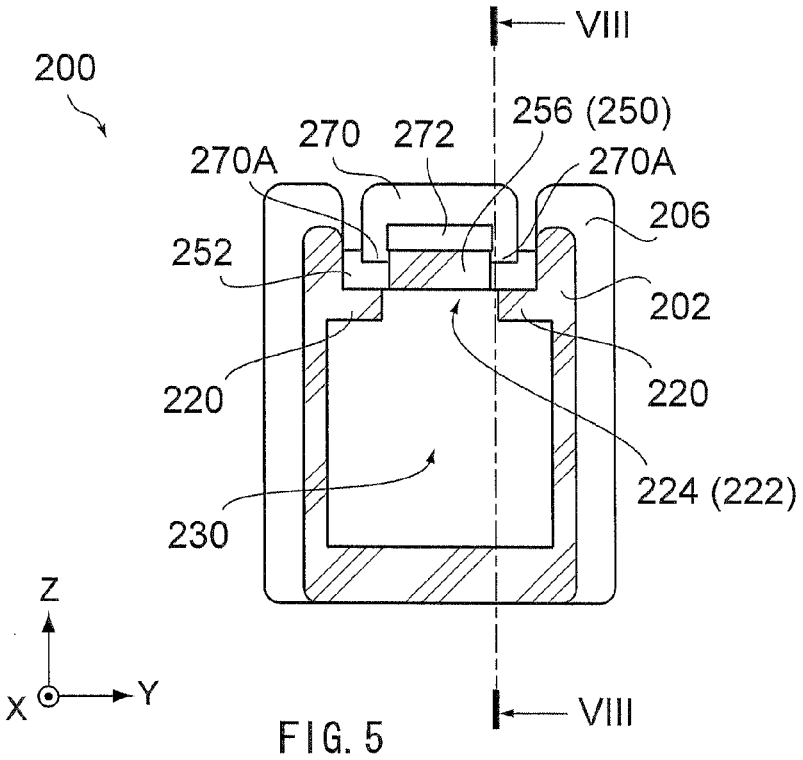
FIG. 5 is a cross-sectional view showing the housing of FIG. 3, taken along line V-V.
Figure 6:
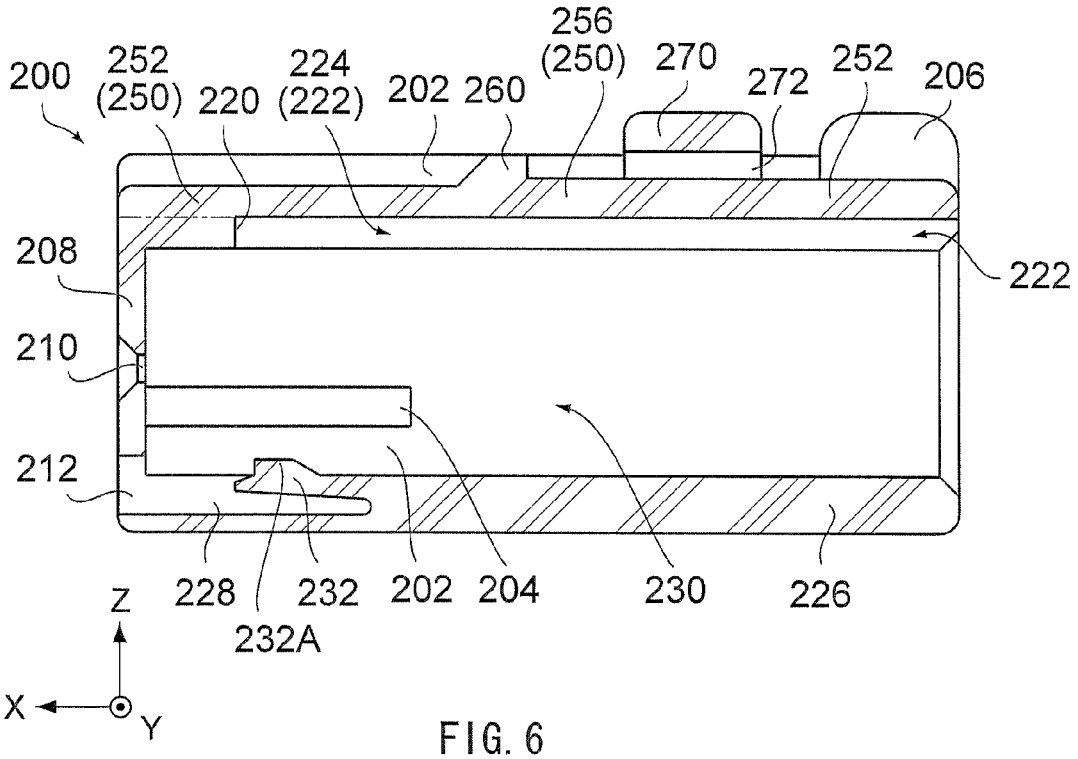
FIG. 6 is a cross-sectional view showing the housing of FIG. 4, taken along line VI-VI, wherein the boundary between the front wall and the lock portion of the housing is illustrated by two-dot chain line.

As shown in FIGS. 1, 5 and 6, the housing 200 is formed with an accommodating portion 230 therewithin. The accommodating portion 230 according to the present embodiment is a space having a rectangular column-like shape enclosed by the side walls 202 and bottom plate 226. The accommodating portion 230 extends in the negative X-direction from the front wall 208 to open at a rear end of the housing 200.

As shown in FIGS. 1, 2, 4 and 6, each of the side walls 202 is formed with a guide channel 204. The guide channel 204 is provided at a front side (i.e. positive X-side) of the side wall 202 in the X-direction. In detail, the guide channel 204 extends to the front wall 208 along the positive X-direction while piercing the side wall 202 in the Y-direction. The guide channel 204 at the front wall 208 is a recess recessed inward in the Y-direction.

Each of the side walls 202 is provided with a post 206 at a rear end. The post 206 has a plate-like shape extending in the Z-direction. The post 206 according to the present embodiment extends upward beyond an upper end of the side wall 202 in the Z-direction.

Figure 4:
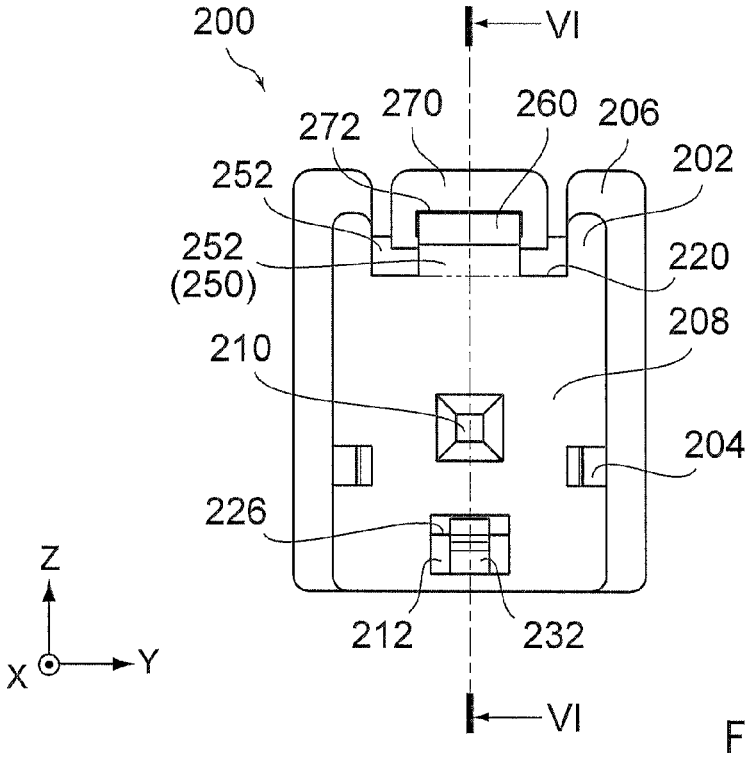
FIG. 4 is a front view showing the housing of FIG. 3, wherein a boundary between a front wall and a lock portion of the housing is illustrated by two-dot chain line.

As shown in FIGS. 2, 4 and 6, the front wall 208 is formed with a connection hole 210 and a release hole 212. Each of the connection hole 210 and the release hole 212 pierces the front wall 208 in the X-direction to communicate with the accommodating portion 230. The release hole 212 is provided in the vicinity of a lower end of the front wall 208. As shown in FIG. 6, a part of the bottom plate 226, which is located behind of the release hole 212, is partially cut so that the bottom plate 226 is formed with a recess 228 recessed downward (i.e. in the negative Z-direction).

As shown in FIGS. 4 and 6, the bottom plate 226 is provided with a lance 232. The lance 232 extends forward (i.e. along the positive X-direction) from a rear end of the recess 228 of the bottom plate 226. More specifically, most of the lance 232 extends toward the front wall 208 within the recess 228. The lance 232 partially protrudes upward over the recess 228 so that the lance 232 is formed with a protruding portion 232A located within the accommodating portion 230. The protruding portion 232A has a front end which is formed in a planar shape perpendicular to the X-direction.

Figure 3:
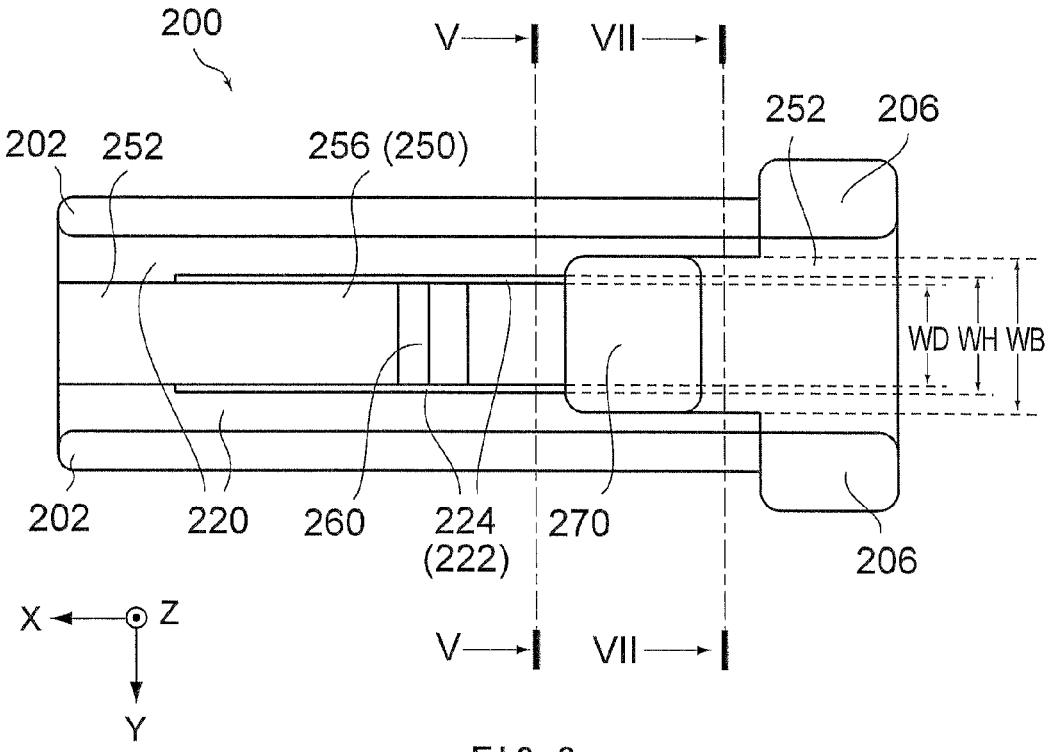
FIG. 3 is a top view showing a housing of the connector of FIG. 2.

As shown in FIGS. 1, 3 and 6, the upper wall 220 is located at the upper part of the housing 200 in the Z-direction. The upper wall 220 is formed with a ditch 222. The accommodating portion 230 is located under the upper wall 220 while communicating with the ditch 222. The ditch 222 is located at a middle part of the upper wall 220 in the Y-direction. In detail, the ditch 222 extends to a rear end of the upper wall 220 in the X-direction while cutting the upper wall 220 from below. The front of the ditch 222 is blocked by the upper wall 220 (see FIG. 6).

As shown in FIGS. 3, 5, 6 and 8, the ditch 222 has a through hole 224 piercing the upper wall 220 in the Z-direction. The through hole 224 is located at a middle part of the housing 200 in the Y-direction.

As shown in FIGS. 1 to 6, the housing 200 has a lock portion 250. The lock portion 250 extends in the X-direction. According to the present embodiment, the opposite ends of the lock portion 250 in the X-direction are integrally formed with the upper wall 220. In detail, the lock portion 250 has two fixed portions 252. The fixed portions 252 are formed at the opposite ends of the lock portion 250 in the X-direction, respectively. Each of the fixed portions 252 is integrally formed with the upper wall 220 so as to protrude upward continuously from the upper wall 220. In other words, the housing 200 has the upper part located above the accommodating portion 230. According to the present embodiment, the upper part of the housing 200 includes the upper wall 220 and the fixed portion 252 which is located above the upper wall 220 (see FIG. 6).

As shown in FIGS. 1 to 3, the lock portion 250 has a flexible portion 256.

As shown in FIGS. 3 and 5 to 8, the flexible portion 256 according to the present embodiment has a plate-like shape extending in the X-direction. The flexible portion 256 extends to couple the two fixed portions 252 in the X-direction so that the flexible portion 256 is resiliently deformable in the Z-direction. In other words, the flexible portion 256 is bendable in the Z-direction. In detail, the flexible portion 256 is located on the through hole 224 in the Z-direction. The opposite sides (i.e. opposite side surfaces) of the flexible portion 256 in the Y-direction are located between the opposite sides (i.e. opposite side surfaces) of the through hole 224 in the Y-direction. The opposite ends of the flexible portion 256 in the X-direction are connected to the fixed portions 252, respectively.

In other words, the lock portion 250 extends in the X-direction so that the flexible portion 256 is located inside of the through hole 224 in the Y-direction. The opposite ends (i.e. the fixed portions 252) of the lock portion 250 in the X-direction are supported by the housing 200 so that the flexible portion 256 is resiliently deformable into the through hole 224. The fixed portions 252 according to the present embodiment are fixed to and supported by the upper wall 220 of the housing 200. However, it is possible to support the fixed portions 252 by a part other than the upper wall 220 of the housing 200.

As shown in FIGS. 1 to 3, the flexible portion 256 is provided with a lock protrusion 260 and an operation portion 270.

As shown in FIGS. 1 to 4 and 6, the lock protrusion 260 protrudes upward (i.e. in the positive Z-direction) from the flexible portion 256. In detail, the lock protrusion 260 according to the present embodiment has a front surface (i.e. positive X-side slope) oblique to both the Z-direction and X-direction, and a rear surface (i.e. negative X-side vertical surface) perpendicular to the X-direction. According to the present embodiment, an upper end of the lock protrusion 260 is located at the same position as the upper end of the side wall 202 (see FIG. 6). The lock protrusion 260 is movable in the Z-direction by a resilient deformation of the flexible portion 256. According to the present embodiment, the lock protrusion 260 is provided at a part which moves largely when the flexible portion 256 is resiliently deformed. More specifically, the lock protrusion 260 is provided in the vicinity of the middle of the two fixed portions 252 in the X-direction (see FIG. 3).

As shown in FIGS. 1 to 6, the operation portion 270 according to the present embodiment has a flat boxlike shape. However, the shape of the operation portion 270 may not be boxlike. The operation portion 270 protrudes upward from the flexible portion 256. In detail, the operation portion 270 has an upper end formed with an upper surface (i.e. horizontal surface) perpendicular to the Z-direction. The upper surface of the operation portion 270 protrudes upward beyond the lock protrusion 260 to be located at the same position as an upper end of the post 206 in the Z-direction.

As can be seen from FIGS. 1, 2, 4, 5 and 8, the operation portion 270 is fixed to and supported by the flexible portion 256. In detail, the operation portion 270 is formed with a hole 272 piercing the operation portion 270 in the X-direction. The hole 272 has a cross-section slightly larger than the lock protrusion 260 in the YZ-plane (see FIG. 4). The operation portion 270 has a square bracket-like shape in the YZ-plane (see FIG. 4). The opposite ends of the operation portion 270 in the Y-direction are connected to the opposite ends of the flexible portion 256 in the Y-direction, respectively. In other words, the operation portion 270 has two coupling portions 270A which are located outward of the flexible portion 256 in the Y-direction and located below an upper surface of the flexible portion 256 in the Z-direction (see FIGS. 5 and 8).

Figure 7:
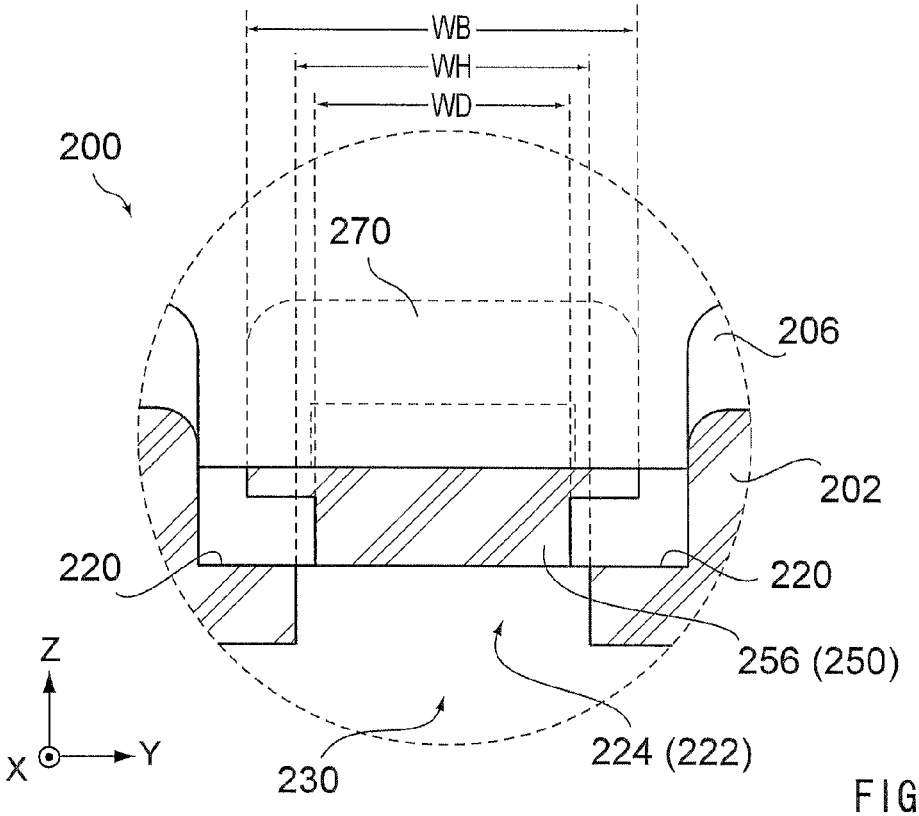
FIG. 7 is a cross-sectional view showing the vicinity of the lock portion of the housing of FIG. 3, taken along line VII-VII, wherein an outline of an operation portion of the lock portion is illustrated by dashed line.
Figure 8:
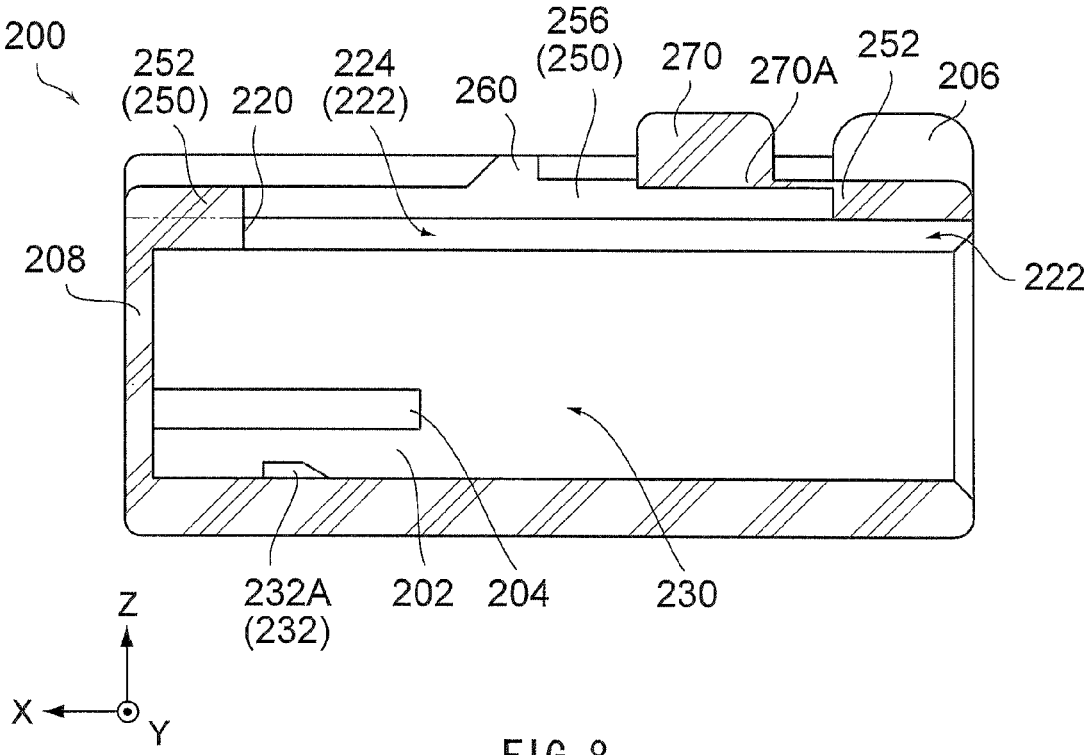
FIG. 8 is a cross-sectional view showing the housing of FIG. 5, taken along line VIII-VIII, wherein the boundary between the front wall and the lock portion of the housing is illustrated by two-dot chain line.

As shown in FIGS. 5, 7 and 8, the coupling portion 270A (i.e. the operation portion 270) is located at a distance over the upper wall 220 so that the operation portion 270 is movable downward. Especially, according to the present embodiment, a part of the flexible portion 256, which is located rearward of the coupling portion 270A in the X-direction, extends to the fixed portion 252 so as to be located at a distance above the upper wall 220 (see FIG. 8). Accordingly, the operation portion 270 according to the present embodiment is easily movable downward.

As shown in FIGS. 3 and 7, a size (i.e. a width WD) of the flexible portion 256 in the Y-direction is smaller than a size (i.e. a width WH) of the through hole 224 in the Y-direction. Accordingly, when the operation portion 270 moves downward (i.e. when the operation portion 270 is pressed downward), the flexible portion 256 (accordingly, the lock protrusion 260) moves downward while passing through the inside of the through hole 224. The operation portion 270 according to the present embodiment is provided in the vicinity of one of the fixed portions 252 in the X-direction. More specifically, the operation portion 270 is located between the lock protrusion 260 and the rearward fixed portion 252. Accordingly, the lock protrusion 260 moves largely by a small movement of the operation portion 270.

A size (i.e. width WB) of the operation portion 270 in the Y-direction is larger than the size of the through hole 224 in the Y-direction. Accordingly, when the operation portion 270 moves downward, the operation portion 270 is interfered by the upper wall 220 so that the operation portion 270 is not inserted into the through hole 224. In other words, the operation portion 270 is configured to be brought into abutment (i.e. brought into contact) with the upper wall 220 when moving downward. Thus, according to the present embodiment, it is possible to prevent an excess movement of the flexible portion 256. More specifically, even if the operation portion 270 is pressed by a strong force, it is possible to prevent the operation portion 270 from being caught in the accommodating portion 230, and prevent the flexible portion 256 from being damaged. The operation portion 270 according to the present embodiment is located at the middle of the flexible portion 256 in the Y-direction. A position of the operation portion 270 in the Y-direction may be shifted to the positive Y-side or the negative Y-side of the flexible portion 256. In this case, it is possible to configure that the operation portion 270 is brought into abutment with the upper wall 220 even if the width WB of the operation portion 270 is smaller than the width WH of the through hole 224. However, it is preferred to configure similar to the present embodiment so as to more securely stop the downward movement of the operation portion 270.

As can be seen from FIGS. 1 to 4, the ditch 222 according to the present embodiment is a trace which is formed by pulling out a metal mold which is used to form the housing 200. According to the present embodiment, the ditch 222 is thus formed so that it is possible to form the housing 200 from a single component without using complicated metal molds. According to the present embodiment, all of the portions (i.e. components) constituting the housing 200, such as the side walls 202, the posts 206, the front wall 208, the upper wall 220, the bottom plate 226, the accommodating portion 230 and the lock portion 250, are formed integrally. It is therefore possible to reduce the number of the components. Some of the aforementioned portions may be formed separately, provided that the upper wall 220, the accommodating portion 230 and the lock portion 250 are formed integrally. However, it is preferred to configure similar to the present embodiment so as to reduce the number of the components.

As can be seen from FIG. 12, the terminal 400 according to the present embodiment is inserted in the housing 200 along the positive X-direction in a state where the terminal 400 is connected and fixed to the cable 900. More specifically, the accommodating portion 230 of the housing 200 accommodates the terminal 400 inserted thereinto along the positive X-direction from behind the connector 10.

Figure 11:
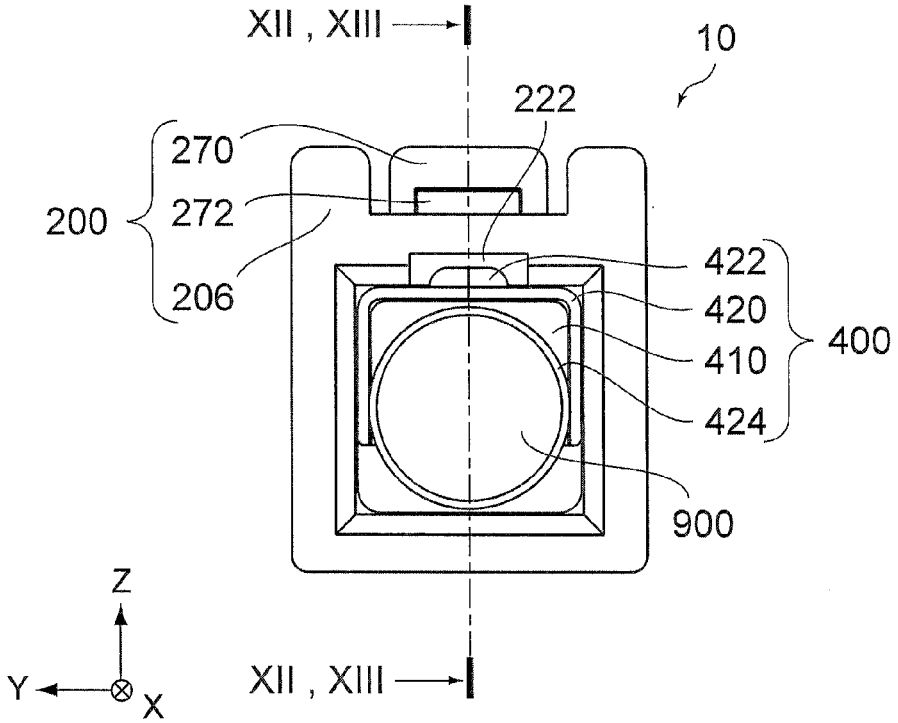
FIG. 11 is a rear view showing the connector of FIG. 1.

As can be seen from FIGS. 11 and 12, the ditch 222 guides the protrusion 422 of the terminal 400 when the terminal 400 is inserted into the accommodating portion 230. In other words, the ditch 222 according to the present embodiment prevents the terminal 400 from being inserted upside down when the terminal 400 is inserted into the accommodating portion 230.

When the terminal 400 is inserted into the accommodating portion 230, an end portion (i.e. the positive X-side end) of the terminal 400 moves forward while pushing down the lance 232 to the recess 228. When the end portion of the terminal 400 arrives in the vicinity of the connection hole 210, the protruding portion 232A of the lance 232 is engaged with the engaged portion 426 of the terminal 400. In detail, a front edge of the engaged portion 426 is brought into abutment with the vertical surface of the protruding portion 232A if the terminal 400 receives a force along the negative X-direction so that the terminal 400 is prevented from being removed unintentionally.

As can be seen from FIGS. 4 and 12, when the housing 200 is seen rearward under a terminal-holding state where the terminal 400 is accommodated and held in the accommodating portion 230, a front end of the lance 232 is visible through the release hole 212 (see FIG. 4). It is therefore possible to release an engagement of the lance 232 with the terminal 400, for example, by pressing down the front end of the lance 232 with a tool inserted from the release hole 212.

Moreover, as can be seen from FIGS. 4, 9 and 12, when the housing 200 is seen rearward under the terminal-holding state, a front end of the shell 420 of the terminal 400 is visible through the release hole 212. It is therefore possible to check whether the shell 420 and the outer conductor 910 are electrically connected or not, for example, by bringing the shell 420 into contact with a terminal of a circuit tester inserted through the release hole 212.

Figure 13:
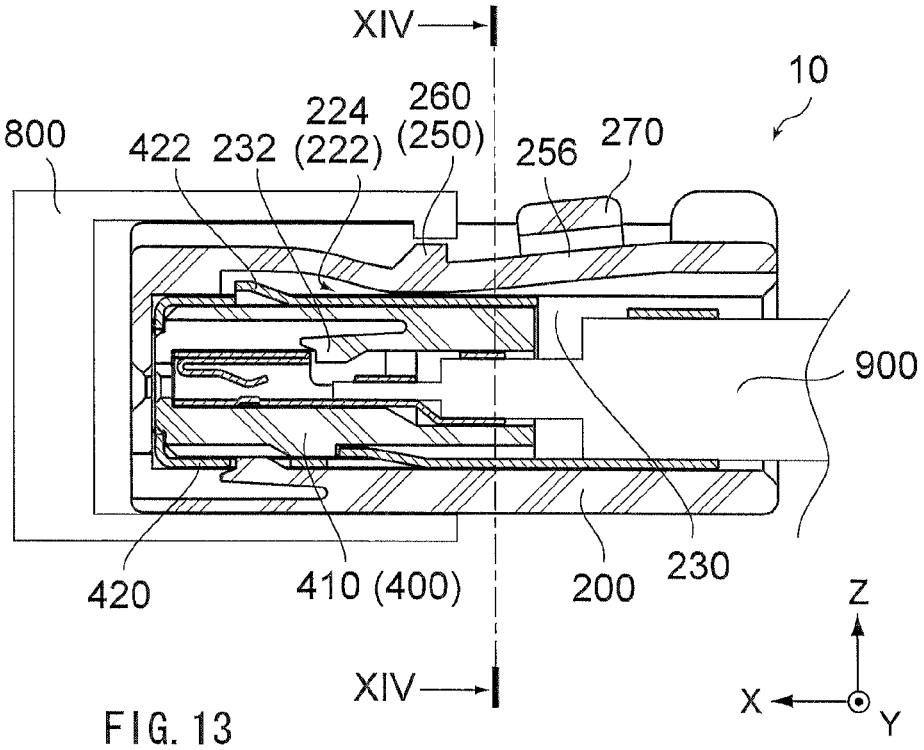
FIG. 13 is a cross-sectional view showing the connector of FIG. 11 in a state where the operation portion is pressed down, taken along line XIII-XIII, wherein the outlines of the cable and the mating connector are schematically illustrated.
Figure 14:
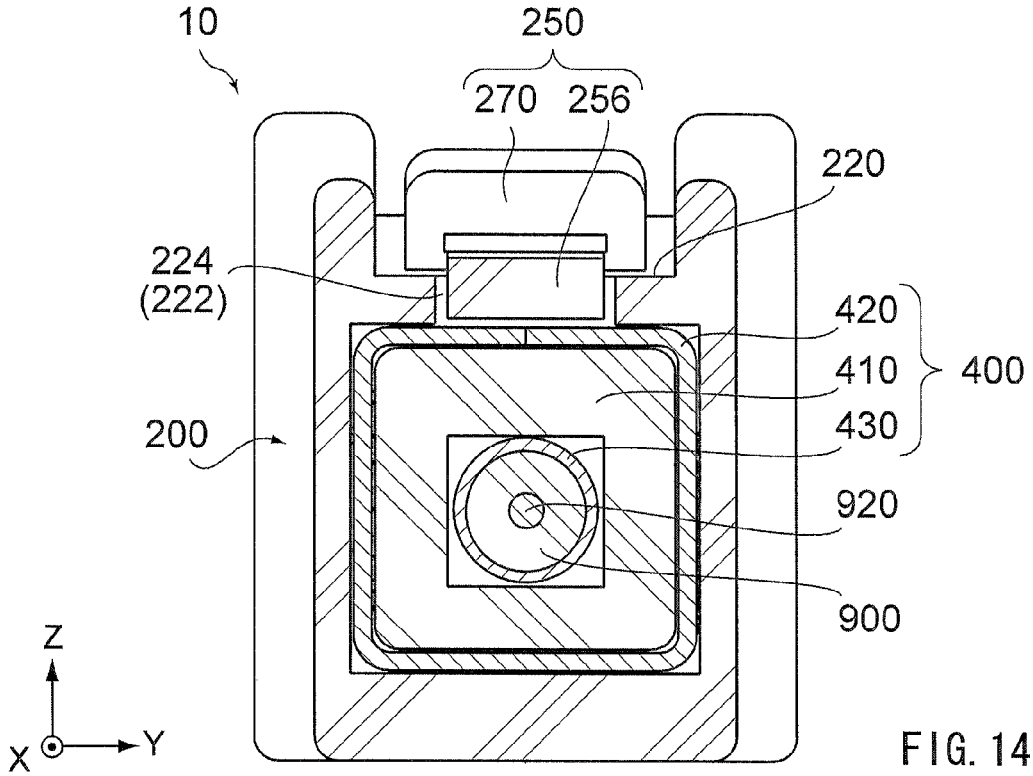
FIG. 14 is a cross-sectional view showing the connector of FIG. 13, taken along line XIV-XIV.
Figure 15:
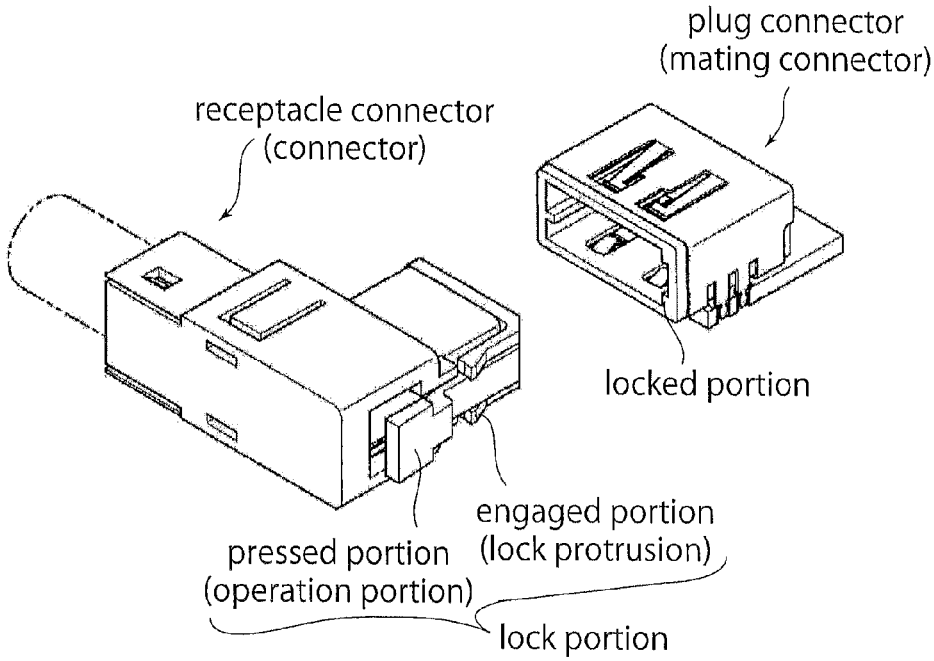
FIG. 15 PRIOR ART
FIG. 15 is a perspective view showing an existing connector.
Figure 16:
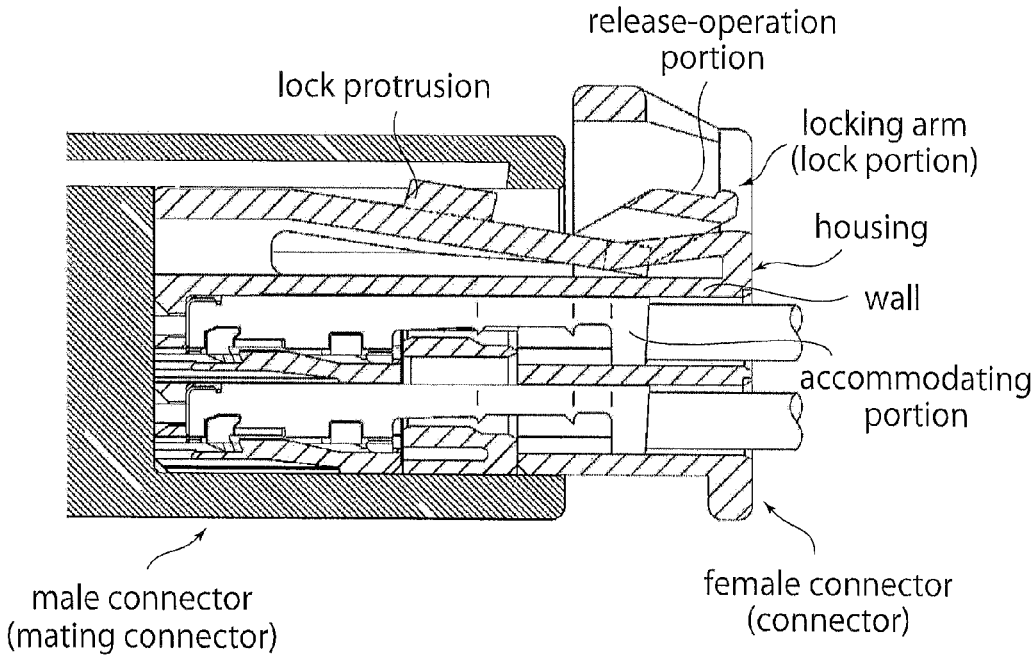
FIG. 16 PRIOR ART
FIG. 16 is a cross-sectional view showing another existing connector.
Figure 17:
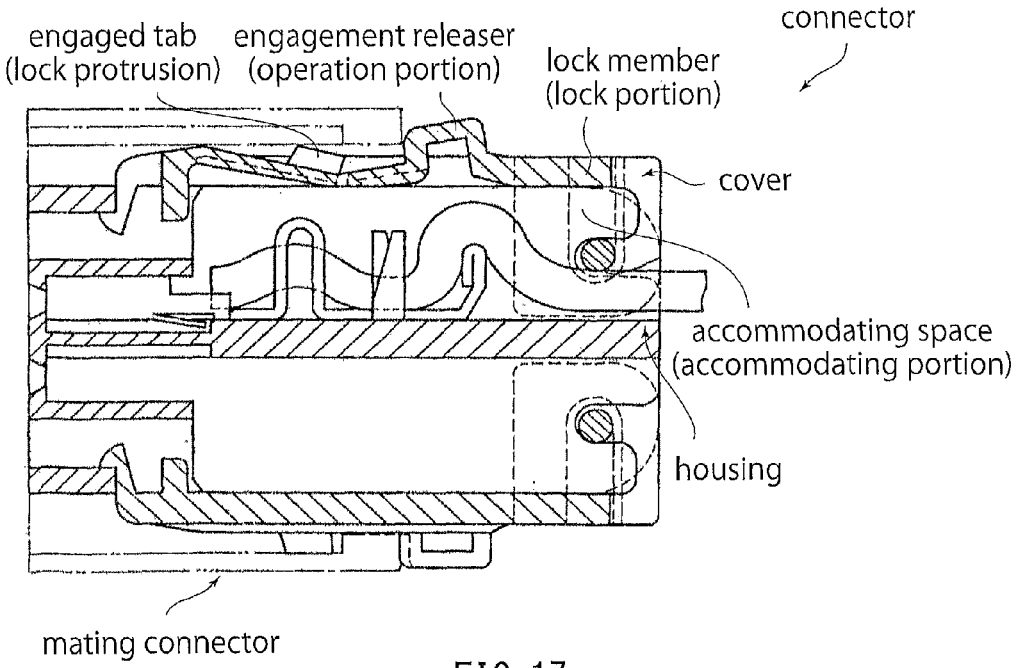
FIG. 17 PRIOR ART
FIG. 17 is a cross-sectional view showing yet another existing connector.

As can be seen from FIGS. 12 and 13, the connector 10 under the terminal-holding state is mateable and connectable with the mating connector 800. More specifically, when the connector 10 is inserted into the mating connector 800 along the X-direction, the forward slope of the lock protrusion 260 moves downward to pass over an end of the mating connector 800. When the lock protrusion 260 is inserted within the mating connector 800 (i.e. when the connector 10 is mated with the mating connector 800), the lock protrusion 260 returns to its initial position to lock the mating connector 800. In other words, the lock protrusion 260 locks the mated state of the connector 10 with the mating connector 800. More specifically, the rearward vertical surface of the lock protrusion 260 is brought into abutment with the end of the mating connector 800 when the connector 10 receives a force along the negative X-direction so that it is possible to prevent the connector 10 from being removed unintentionally.

As can be seen from FIG. 12, when the connector 10 and the mating connector 800 is in the mated state, the mating contact (not shown) is inserted in the contact-accommodating portion 436 through the connection hole 210 and the terminal-connection hole 416 to be brought into contact with the contact portion 434 of the contact 430. In other words, the connector 10 and the mating connector 800 are electrically connected to each other.

As can be seen from FIGS. 2, 4 and 12, a part of a shell (not shown) of the mating connector 800 is connected to the shell 420 of the terminal 400 through the guide channel 204 under the mated state (see FIG. 12).

As can be seen from FIGS. 12 and 13, when the operation portion 270 is pressed downward under the mated state, the lock protrusion 260 moves below the end of the mating connector 800 (see FIG. 13). Accordingly, the connector 10 is removed from the mating connector 800 when being pulled in the negative X-direction.

As shown in FIGS. 12 and 13, according to the present embodiment, the lock protrusion 260 of the lock portion 250 is located between the protrusion 422 of the terminal 400 and the operation portion 270 in the X-direction. Accordingly, the protrusion 422 does not interfere with the downward movement of the lock protrusion 260. In other words, the lock protrusion 260 is located above the terminal 400 both when the lock protrusion 260 is located at the initial position (i.e. under the mated state) and even when the lock protrusion 260 moves downward.

As described above, according to the present embodiment, no wall, which reduces a space where the flexible portion 256 is resiliently deformable, is formed between the flexible portion 256 of the lock portion 250 and the accommodating portion 230. Accordingly, the flexible portion 256 is resiliently deformable to the vicinity of an upper end of the terminal 400. In other words, it is possible to use a room including the vicinity of the upper end of the terminal 400 as a space where the flexible portion 256 is resiliently deformed. According to the present embodiment, it is possible to further reduce the connector 10.

The present invention is able to be modified variously in addition to the aforementioned description. For example, although the lock portion 250 according to the present embodiment is supported in a both-ends support structure, the lock portion 250 may be supported in a cantilever structure. More specifically, it is possible to support only one of the fixed portions 252 (see FIG. 3) by the housing 200. In other words, at least one of the opposite ends of the lock portion 250 in the X-direction may be supported by the housing 200 so that the flexible portion 256 is resiliently deformable into the through hole 224.

However, as can be seen from FIGS. 2 and 12, if the flexible portion 256 is supported only by the fixed portion 252 located at the negative X-side (i.e. if the positive X-side end of the flexible portion 256 is a free end), the lock by the lock portion 250 may easily released. In other words, the locking strength of the connector 10 with the mating connector 800 may be weakened. On the contrary, if the flexible portion 256 is supported only by the fixed portion 252 located at the positive X-side, it is necessary to move the operation portion 270 largely in order to move the lock protrusion 260 by a necessary distance (i.e. predetermined distance). Accordingly, a size of the connector 10 may become large. It is therefore preferred in general to support the lock portion 250 in a both-ends support structure similar to the present embodiment.

The present application is based on a Japanese patent application of JP2012-103075 filed before the Japan Patent Office on Apr. 27, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector positioned forward along a front-rear direction, the mating connector comprising a mating terminal, the connector comprising:

a terminal connectable to the mating terminal;

a housing having an upper wall, an accommodating portion and a lock portion which are formed integrally, the upper wall being located at an upper part of the housing in an up-down direction perpendicular to the front-rear direction, the upper wall being formed with a ditch extending to a rear end of the upper wall in the front-rear direction, the ditch having a through hole piercing the upper wall in the up-down direction, the accommodating portion being located under the upper wall while communicating with the ditch, the accommodating portion accommodating the terminal inserted thereinto along the front-rear direction from behind the connector, the lock portion having a flexible portion, the flexible portion being provided with a lock protrusion protruding upward, the lock portion extending in the front-rear direction so that the flexible portion is located inside of the through hole in a width direction perpendicular to both the front-rear direction and the up-down direction, at least one of opposite ends of the lock portion in the front-rear direction is supported by the housing so that the flexible portion is resiliently deformable into the through hole, the lock protrusion being movable in the up-down direction by a resilient deformation of the flexible portion, the lock protrusion locking the mating connector when the connector is mated with the mating connector.

2. The connector as recited in claim 1, wherein the lock protrusion is located above the terminal even when moving downward.

3. The connector as recited in claim 1, wherein the opposite ends of the lock portion in the front-rear direction are supported by the upper wall.

4. The connector as recited in claim 1, wherein:

the flexible portion is provided with an operation portion, the operation portion being located at a distance over the upper wall so that the operation portion is movable downward; and the lock protrusion moves downward when the operation portion moves downward.

5. The connector as recited in claim 4, wherein the operation portion is configured to be brought into contact with the upper wall when moving downward.

6. The connector as recited in claim 5, wherein a size of the operation portion in the width direction is larger than another size of the through hole in the width direction.

7. The connector as recited in claim 1, wherein:

the terminal is provided with a protrusion at an upper part thereof; and the ditch guides the protrusion when the terminal is inserted into the accommodating portion.

8. The connector as recited in claim 7, wherein the lock protrusion of the lock portion is located between the protrusion of the terminal and the operation portion in the front-rear direction.

9. The connector as recited in claim 1, wherein the terminal comprises a terminal housing, a shell covering the terminal housing and a contact held by the terminal housing.

* * * * *